United States Patent [19]

Hanson et al.

[11] Patent Number: 4,858,347

[45] Date of Patent: Aug. 22, 1989

[54] CONTINUOUS EXCAVATING APPARATUS AND METHODS

[75] Inventors: R. A. Hanson; Jerry Morton, both of Spokane, Wash.

[73] Assignee: R. A. Hanson Company, Inc., Spokane, Wash.

[21] Appl. No.: 185,983

[22] Filed: Apr. 25, 1988

[51] Int. Cl.[4] ..... E02F 3/18; E21C 37/00

[52] U.S. Cl. ..... 37/190; 299/64; 299/53; 37/195

[58] Field of Search ..... 37/189, 190, 195; 299/64, 67, 42–45, 53, 78

[56] References Cited

U.S. PATENT DOCUMENTS

| | | | |
|---|---|---|---|
| 12,261 | 5/1909 | Lamperiere | 37/190 |
| 748,616 | 1/1904 | Karr | 37/190 |
| 1,332,662 | 3/1920 | Gross | 299/64 |
| 1,424,093 | 7/1922 | Gilman | 37/190 |
| 1,721,587 | 7/1929 | Burchill | 37/189 |
| 1,764,084 | 6/1930 | Nelson et al. | 37/190 |
| 2,169,518 | 8/1939 | Brady et al. | 37/190 |
| 2,417,846 | 3/1947 | Stevens | 37/190 |
| 2,762,141 | 9/1956 | Le Tourneau | 37/190 |
| 2,834,127 | 5/1958 | Kolbe | 37/189 |
| 3,091,874 | 6/1963 | Wuigk | 37/190 |
| 3,258,865 | 7/1966 | Andorf | 37/190 |
| 3,298,117 | 1/1967 | Pelzer et al. | 37/190 |
| 3,452,461 | 7/1969 | Hanson | 37/190 |
| 3,690,023 | 9/1972 | Peterson | 37/90 |
| 3,779,408 | 12/1973 | Jire | 299/64 |
| 3,841,006 | 10/1974 | Mironov et al. | 37/189 |
| 3,896,571 | 7/1975 | Satterwhite | 37/190 |
| 3,962,803 | 6/1976 | O'Brien | 37/189 |
| 3,966,258 | 6/1976 | Dolecki | 299/76 |
| 4,003,148 | 1/1977 | Satterwhite | 37/190 |
| 4,157,623 | 6/1979 | Satterwhite | 37/190 |
| 4,351,564 | 9/1982 | Droscher et al. | 299/64 |
| 4,616,880 | 10/1986 | Nozaki et al. | 37/190 |
| 4,645,266 | 2/1987 | Paurat et al. | 299/64 |
| 4,669,785 | 6/1987 | Brandl | 299/64 |

FOREIGN PATENT DOCUMENTS

| | | | |
|---|---|---|---|
| 2602756 | 7/1977 | Fed. Rep. of Germany | 37/190 |
| 0053324 | 3/1984 | Japan | 37/189 |
| 0302441 | 6/1971 | U.S.S.R. | 37/189 |
| 0197707 | 7/1977 | U.S.S.R. | 37/189 |
| 0810913 | 3/1981 | U.S.S.R. | 37/189 |
| 1059073 | 12/1983 | U.S.S.R. | 37/189 |
| 1093759 | 5/1984 | U.S.S.R. | 37/189 |
| 1097757 | 6/1984 | U.S.S.R. | 37/189 |
| 1157168 | 5/1985 | U.S.S.R. | 37/189 |
| 1208135 | 1/1986 | U.S.S.R. | 37/189 |

OTHER PUBLICATIONS

Ingersoll-Rand Research, Inc., "Preliminary Design and Analysis of a Continuous Surface Coal Miner", 1975–1976, pp. 14, 79–84, 154–158.

Alpine Equipment Corporation Brochure, "Alpine Miner Model F6-A Continuous Miner and Tunneling Machine".

*Primary Examiner*—Clifford D. Crowder
*Assistant Examiner*—Kimberly L. Asher
*Attorney, Agent, or Firm*—Wells, St. John & Roberts

[57] ABSTRACT

Excavating apparatus and methods for breaking and removing material away from an upright face of material are disclosed. The apparatus employs a rotary cutter for dislodging material from the face. A collector pan extends transversely across the front end of the apparatus. The cutter is elevationally movable relative to the collector pan in both longitudinal and elevational directions above and below the collector pan front edge, and btween positions located longitudinally outward and rearward of the collector pan front transverse edge. A combination grading and collecting device is mounted at an elevational positon below the collector pan front transverse edge. It functions to both gather material dislodged by the cutter and to form surfaces over which the apparatus travels.

27 Claims, 5 Drawing Sheets

FIG. II

CONTINUOUS EXCAVATING APPARATUS AND METHODS

TECHNICAL FIELD

This invention relates generally to excavators and methods of excavation. More particularly, this invention relates to excavators usable for breaking and removing material away from tall upright faces of material and methods of excavating tall upright faces of material.

BACKGROUND OF THE INVENTION

The invention arose out of needs and concerns relating to open pit coal mining. Open pit mining commonly is performed using a combination of drilling and blasting techniques, and excavating machinery to remove material from the open pit. Excavating machinery is also used to break material away from upright faces of material for its subsequent removal from the mining pit. Such machinery typically includes a horizontally mounted, open cutting head having peripheral cutting elements such as teeth or buckets for braking material from the face.

Presently accepted machinery and methods have many drawbacks. For example, some excavating machinery is mounted on three or four track crawlers, requiring an inordinate amount of open pit area for maneuvering. Also, a number of excavators use bucket wheel cutting heads for breaking material from a face. These excavators rough cut a face of material, resulting in a significant loss of product from the face and requiring separate clean-up machines. Bucket wheel excavators are also limited in the hardness of the material that they can effectively remove.

Needs still remain for improved excavating machinery and methods which are capable of removing material from a tall face at high capacity rates. This invention is directed to improved capacity and other operating characteristics and methods in excavating tall faces of material, such as in open coal pit mining.

BRIEF DESCRIPTION OF THE DRAWINGS

Preferred embodiments of the invention are illustrated in the accompanying drawings, in which.

DETAILED DESCRIPTION OF PREFERRED EMBODIMENTS

The following disclosure of the invention is submitted in compliance with the constitutional purpose of the Patent Laws "to promote the progress of science and useful arts" (Article 1, Section 8).

Figure 1:
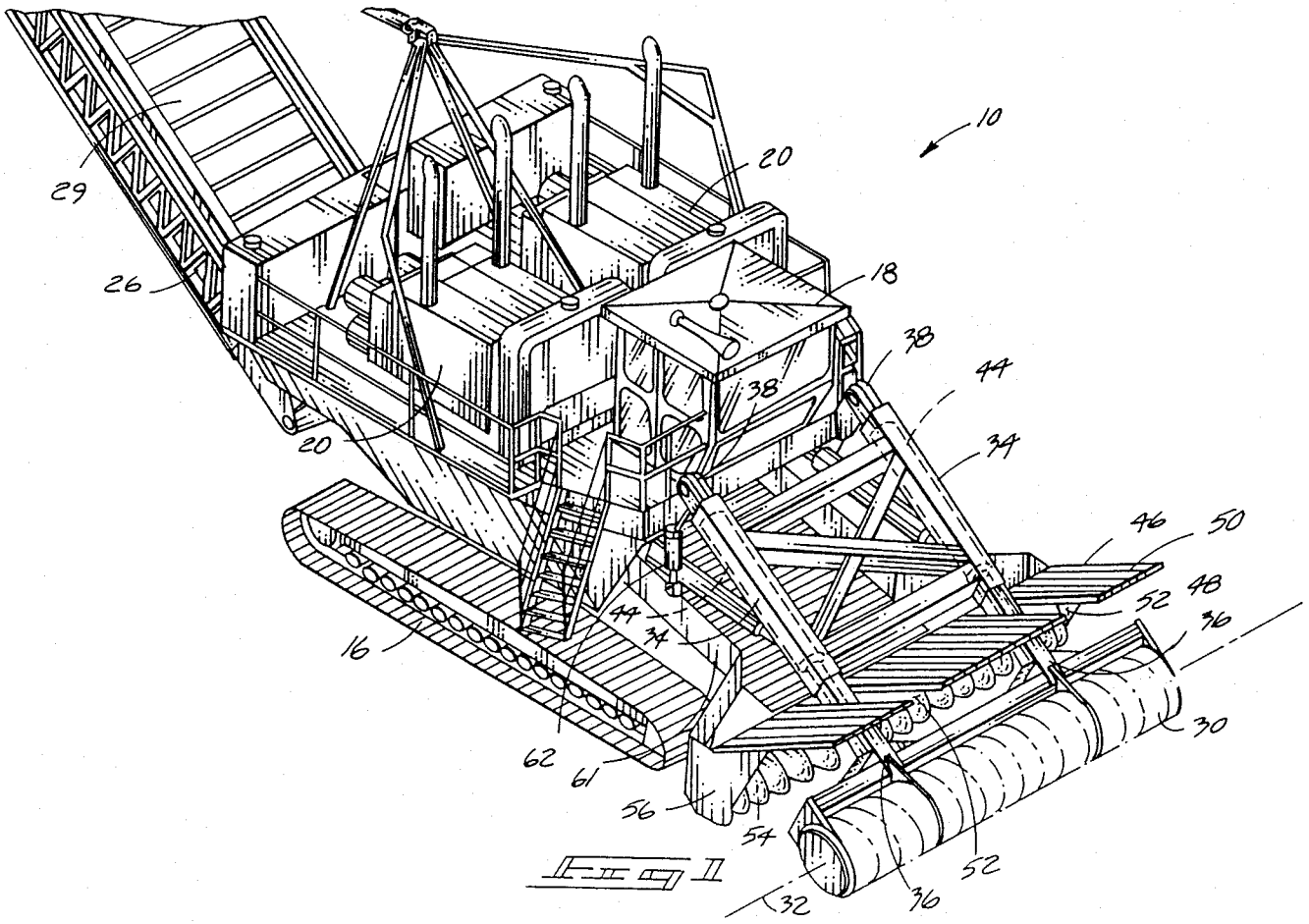
FIG. 1 is an isometric fragmentary view of an excavating apparatus in accordance with the invention.
Figure 2:
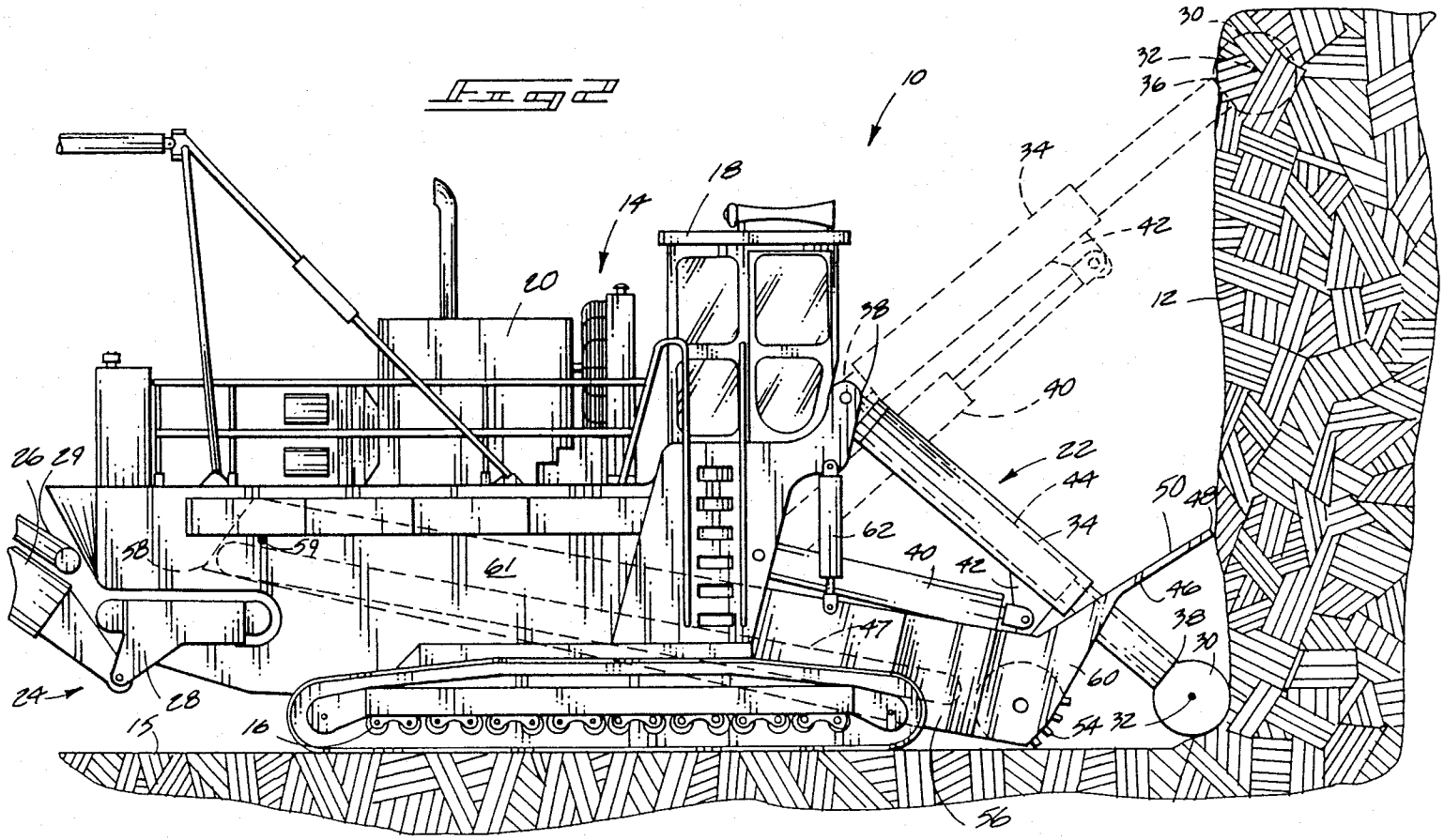
FIG. 2 is an enlarged side elevational view of the excavating apparatus of FIG. 1.

Referring to FIGS. 1 and 2, an excavating apparatus in accordance with the invention is indicated generally by reference numeral 10. Excavator 10 is primarily adapted for breaking and removing material, such as coal, away from an upright face 12 of such material. Excavator 10 includes a general vehicular portion 14 supported by a pair of longitudinally oriented crawler tracks 16. For ease of description, vehicle 14 includes a first or front longitudinal end 22 and a rear or second longitudinal end 24. Tracks 16 support vehicle 14 for movement primarily in a longitudinal direction toward or away from face of material 12 over a surface 15. An operator's cab 18 is positioned at vehicle front end 22 while a conventional discharge conveyor boom 26 extends from vehicle rear end 24. Boom 26 is pivotally supported by means of a swing pivot 28 and also supports a material transport belt 29. Internal combustion power plants 20 are mounted at the center of vehicle 14 for propelling the vehicle and powering the various equipment on the vehicle.

A rotary cutter means 30 is supported outwardly from first or front longitudinal end 22 of vehicle 14. Its function is to engage and dislodge material from coal face 12. It is supported for rotation about a transverse axis 32 which extends perpendicularly relative to the longitudinal orientation of vehicle 14. It is mounted for elevational movement relative to vehicle 14 and operatively connects with positioning means that provides for such elevational movement.

In the depicted embodiment, the positioning means comprises a pair of boom arms 34 which operatively connect with and extend between vehicle first longitudinal end 22 and cutter 30. One or an inner end 38 of each boom arm 34 is pivotally connected to vehicle 14 while opposite or outer end 36 of each boom arm 34 rotationally supports cutter 30. A lug 42 extends downwardly rom each boom arm 34. An elevational control cylinder 40 is positioned beneath each boom arm 34 and pivotally connects between and with vehicle 14 and lug 42. Control cylinders 40 are hydraulically powered, being extendible and retractable, and cause pivotal movement of arms 34 relative to vehicle 14 for causing elevational movement of cutter 30 relative to vehicle 14.

In the preferred and depicted embodiment, boom arms 34 are of a two-piece telescopic construction, or are otherwise length adjustable. Extension and retraction of telescoping arms 34 are controlled by cylinders 44 mounted within arms 34. This enables longitudinal as well as elevational movement of cutter 30 relative to vehicle 14.

Cutter 30 is rotationally power driven by means of conventional hydraulic motors (not shown in the figures) mounted internally within cutter 30. Hydraulic hoses (not shown) extend from power plants 20 and through telescopic boom arms 34 for powering such motors.

A collector pan 46 extends transversely across vehicle front longitudinal end 22. Collector pan 46 has a front transverse edge 48 and upwardly facing surfaces 50 which incline downwardly and rearwardly relative to the vehicle. Collector pan 46 functions to collect and direct material removed from face 12 by cutter 30 when it is at elevational positions above collector pan front transverse edge 48. Collector pan 46 directs such gathered material rearward to a conveyor 47 on vehicle 14 to transport the removed material away from vehicle front end 22.

Telescopic boom arms 34 are capable of moving cutter 30 relative to collector pan 46 in elevational directions above and below collector pan front transverse edge 48. They are also capable of moving cutter 30 between positions located longitudinally outward and longitudinally rearward of front transverse edge 48. The position of boom arms 34 as shown in dashed lines in FIG. 2 illustrate alternate elevational and longitudinal position of cutter 30 from that shown in solid lines.

Enabling means are provided for accommodating elevational movement of rotary cutter 30 past collector pan front transverse edge 48 without requiring changing of the elevational position of such front transverse edge 48. As shown, the enabling means comprises a pair of longitudinally oriented slots 52 which are provided through collector pan 46 and extend to its front transverse edge 48. Boom arms 34 are extendible through slots 52, as illustrated in FIG. 1. Alternate enabling means could also of course be provided. For example, boom arms 34 could be configured to engage cutter 30 laterally outward of collector pan 46 and thereby pass to the sides of pan 46.

A combination grading and collecting wheel or device 54 is mounted to front end 22 of vehicle 14 at an elevational position below collector pan front transverse edge 48. A first function of device 54 is to gather material dislodged by cutter 30 from face 12 that collects beneath collector pan 46 at surface 15 over which vehicle 14 travels, and transport such material to conveyor 47. A second function of device 54 is to grade surface 15 by removing material from such surface and transporting it to conveyor 47.

In the depicted embodiment, collector pan 46 and combination device 54 are mounted relative to vehicle 14 by a conmmon support frame 56 which also supports conveyor 47. Common frame 56 includes a rear longitudinal end 58 which pivotally connects at rear end 24 of the vehicle 14 at a pivot location 59. A front end 60 of common frame 56 rotationally supports combination device 54. It is rotationally driven by hydraulic motors in a manner similar to that which cutter 30 is rotationally driven, as described above. Conveyor 47 is supported longitudinally between ends 58, 60 and between frame elevational side walls 61. These function to confine or direct material as it is transported rearwardly by conveyor 47.

Collector pan 46 extends upwardly from front end 60 of common frame 56. The rearmost portion of collector pan 46 terminates above combination device 54 to direct falling material to conveyor 47. Alternately, collector pan 46 could extend rearwardly and terminate above the front end of conveyor 47.

Common frame 56 is mounted for elevational movement relative to vehicle 14 to move collector pan 46, combination device 54, and the front end of conveyor 47 vertically in unison. Such elevational movement is accommodated by the pivotal mounting of common frame 56 at pivot 59 adjacent vehicle rear end 24. A pair of grade control cylinders 62 pivotally connect between vehicle front end 22 and the upper portion of common frame side walls 61 below vehicle front end 22. Grade control cylinders 62 enable selective pivoting of frame 56 about pivot 59 to raise or lower the front end thereof. Raising or lowering the front end of common frame 56 enables control of the grade of surface 15 as vehicle 14 moves in the direction of face 12.

Figure 3:
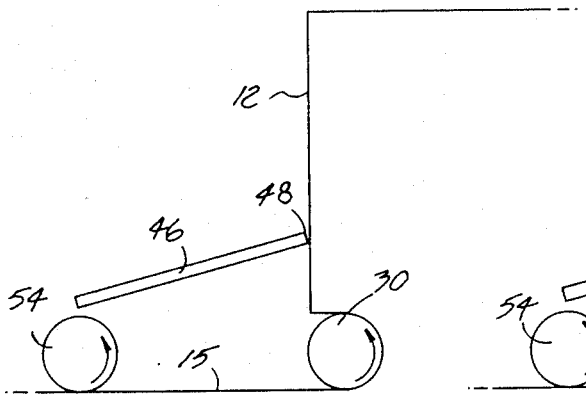
FIGS. 3–8 are sequential diagrammatic side elevational views illustrating one example of an excavating method in accordance with the invention.

An apparatus in accordance with the invention enables improved excavating techniques for mining tall faces of ore material. The reader's attention is first directed to FIGS. 2–8 for a sequential description of one such method in accordance with the invention. FIGS. 3–8 referred to in the ensuing description are abbreviated diagrammatic versions of FIG. 2. There illustrated are the outlines of combination device 54 and cutter 30, and collector pan 46 and its associated front edge 48 relative to the face of material 12 being excavated. To begin the described method of excavation, excavating vehicle 14 is first positioned over surface 15 and adjacent face 12 to be excavated. The vehicle would be oriented as illustrated in FIG. 2 with collector pan front edge 48 against or closely adjacent face 12. Combination device 54 and cutter 30 are started rotating in a counterclockwise direction. Clockwise rotation might also be workable, but counterclockwise rotation is preferred. Cutter 30 is progressively moved forwardly into face 12 by extending telescopic arms 34 with cylinders 44 and pivoting such arms upwardly with cylinders 40 to cause engagement with the face at a location where surface 15 at face 12 intersect (FIG. 3). Forward movement is stopped when engagement of cutter 30 into face 12 is approximately equal to one diameter distance of cutter 30. Material removed from face 12 by cutter 30 is thrown rearwardly in the direction of combination device 54. Combination device 54 gathers such material and transports it to vehicle conveyor 47.

Figure 4:
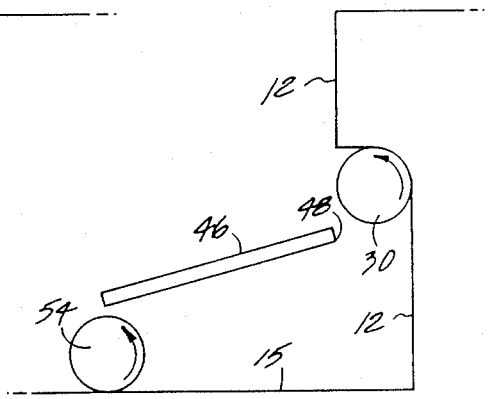

Rotating cutter 30 is then moved upwardly into face 12 to an elevational position above collector pan 46 by pivoting boom arms 34 upwardly with cylinders 40 (FIG. 4). In the depicted and described preferred method, telescopic arms 34 are retracted as they are upwardly pivoted to maintain a substantially vertical face 12. As the upper portion of cutter 30 passes elevationally above collector pan front edge 48, removed material is directed onto inclinded surfaces 50 of collector pan 46 and transported to conveyor 47. Any material falling through collector pan slots 52 to surface 15 wil eventually be transported to conveyor 47 by combination device 54 as vehicle 14 moves in the direction of face 12.

Figure 5:
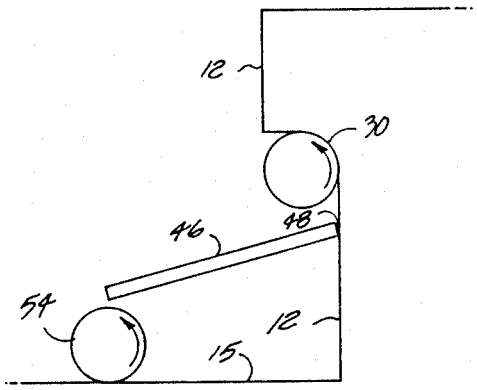
Figure 6:
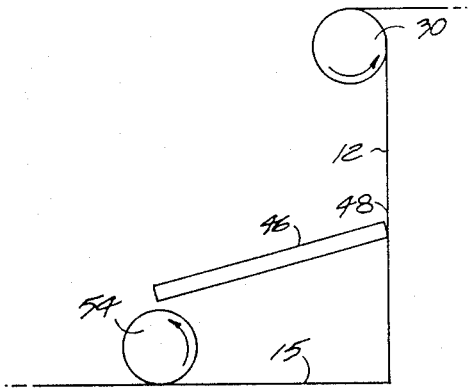

At the point where cutter 30 just clears above collector pan 46 (FIG. 4), vehicle 14 is moved forward to where collector pan front edge 48 is again closely adjacent to or directly contacting face 12. During this vehicle forward movement, telescoping boom arms 34 are retracted and pivoted as necessary to maintain the same relative position of cutter 30 relative to face 12 (FIG. 5). Rotating cutter 30 is then continued to be moved upwardly into face 12 to the upper portion of the face (FIG. 6). Pivoting and extending of boom arms 34 are again preferably coordinated to maintain a substantially vertical face 12.

Figure 7:
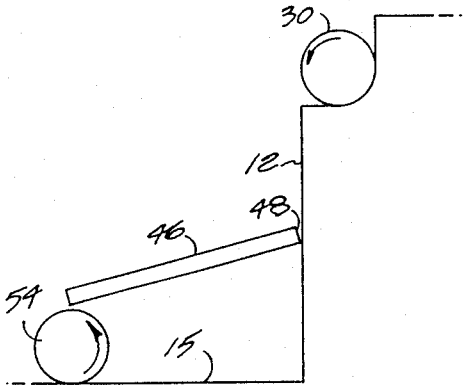
Figure 8:
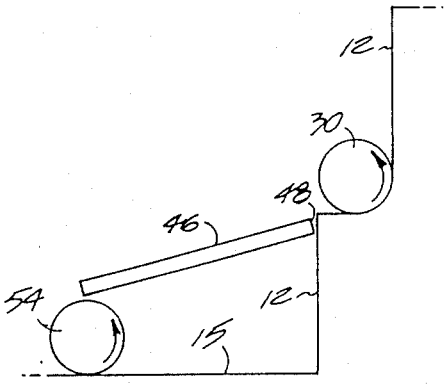
Figure 9:
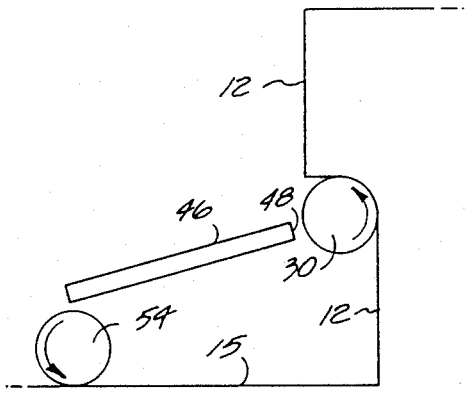
FIGS. 9–14 are sequential diagrammatic side elevational views illustrating another example of an excavating method in accordance with the invention.

Boom arms 34 are then again extended and pivoted downward slightly to move cutter 30 into face 12 at the top portion of the face for beginning a new downward cut (FIGS. 7 and 8). Cutter 30 is then moved downward, removing material from face 12, to a position where it is adjacent surface 15. Then, the excavating steps are repeated.

Combination device 54 will also function to grade or otherwise maintain surface 15 as vehicle 14 is progressively moved forward into face 12. Grade control cylinders 62 are used as necessary to control any desired inclination of surface 15.

In the immediately preceding description, movement of vehicle 14 in the direction of face 12 is comprised in two discrete steps. A first step occurs when rotating cutter 30 is elevationally lower than collector pan 46 to bring the collector pan into engagement with face 12

(FIG. 2). The second step occurs when rotating cutter 30 is elevationally higher than collecting pan 46 (FIG. 5). Also, movement of rotating cutter 30 into face 12 is of a distance of approximately one cutter diameter in epth, with such depth being maintained throughout elevational cutting movements. Alternate excavation methods in accordance with the invention could be conducted without full cutter diameter engagement or discrete movements of vehicle 14 relative to face 12.

Figure 10:
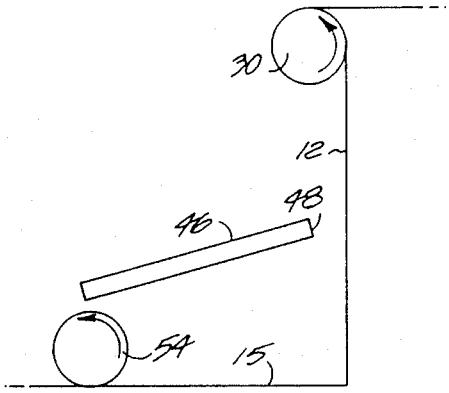

FIGS. 9–14 diagrammatically illustrate another such excavating method wherein vehicle 14 is kept continually moving in the direction of face of material 12 throughout excavation. With vehicle 14 continually moving in the direction of face 12, collector pan transverse edge 48 correspondingly also continually moves in the direction of face 12. In this illustrated and described method, the depth of cutter engagement relative to face 12 is again maintained approximately constant throughout elevational movement at one cutter diameter. Description of the method commences with reference to FIG. 9 where cutter 30 elevationally begins to pass above collector pan 46. Cutter 30 is continued to be raised upwardly with retraction of the telescopic arms being coordinated with elevational and vehicle movement to again maintain a preferred substantially vertical face and one diameter depth cut. At the end of the upward stroke or movement of cutter 30, the excavating configuration will appear as shown in FIG. 10. The telescopic arms are again extended at this position (FIG. 11), and then pivoted downward to move cutter 30 downward relative to face 12.

Figure 11:
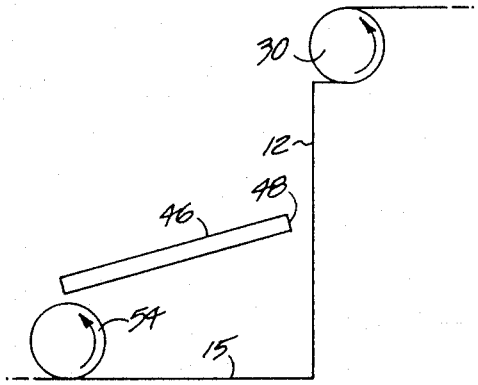
Figure 12:
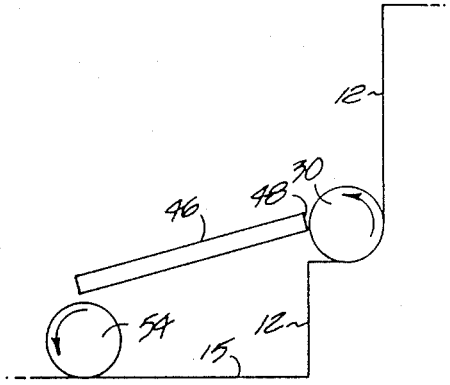

As is apparent from FIGS. 10 and 11, during elevational movements of cutter 30 elevationally above pan 46, front transverse edge 48 of collector pan 46 will be displaced from face 12. As such, more material will typically fall beneath collector pan 46 to be ultimately gathered by combination device 54.

Figure 13:
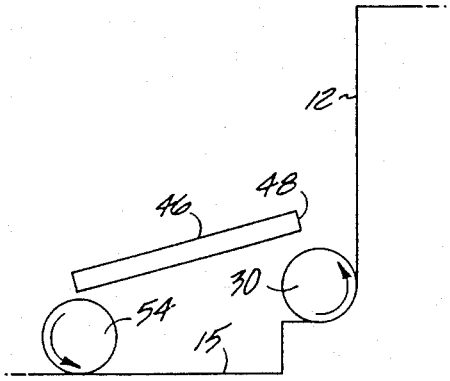
Figure 14:
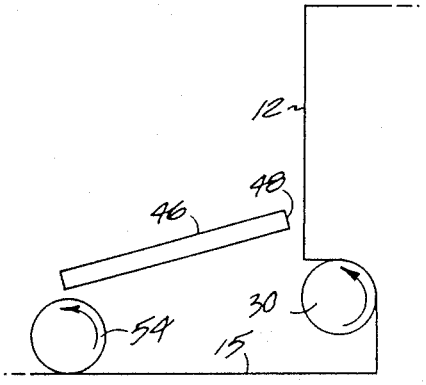

As cutter 30 passes beneath pan 46, the telescopic arms retract as required to maintain the depth of cut and to compensate for the forward movement of the vehicle (FIG. 13). At the bottom of the stroke where cutter 30 is adjacent surface 15, the telescopic arms are extended and pivoted to move cutter 30 into face 12, and moved upwardly to begin another sequence (FIG. 14).

In the described method embodiments, face 12 is sufficiently tall that transverse edge 48 of collector pan 46 engages face 12 elevationally below the face mid-elevation point. If elevational velocity of rotating cutter 30 is maintained generally constant throughout excavation, vehicle velocity will need to be varied depending upon the elevational position of cutter 30 relative to collector pan front edge 48. For example, where cutter 30 is elevationally higher than collector pan front edge 48, vehicle velocity in the direction of face 12 will be less than when cutter 30 is beneath front edge 48. Correspondingly, vehicle velocity in the direction of face 12 when rotating cutter 30 is elevationally lower than collector pan front edge 48 must be greater than when cutter 30 is above front edge 48.

The inventive methods can be performed entirely manually or under microprocessor control. In the preferred embodiments, it is envisioned that microprocessor control will be employed to both increase efficiency of the excavation and reduce required manpower. For example, in addition to looking out of the front of the excavator and controlling the excavating operation, an operator must also control positioning of the discharge conveyor boom 26 for dumping the removed material into trucks or other vehicles. It is very difficult for one individual to coordinate all these operations efficiently and effectively. It is anticipated, absent microprocessor control of various functions, that two operators would be required to effectively operate the excavator.

Figure 15:
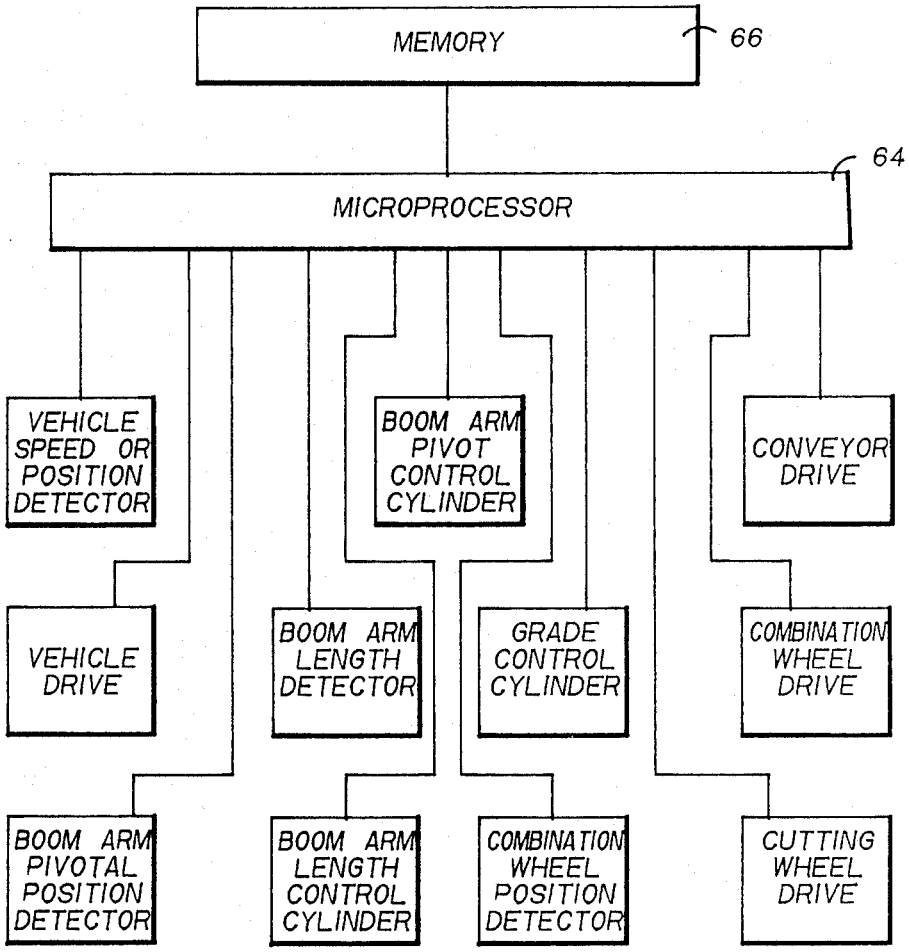
FIG. 15 is a block diagram of a microprocessor control architecture usable for efficiently conducting excavation with the excavator of FIG. 1.

FIG. 15 illustrates in block diagram form how a microprocessor can be employed to coordinate the various excavating functions so that a single operator's attention can be directed to control of the discharge conveyor. A microprocessor 64 receives information relative to positions of the various described components at the front end of the vehicle and controls the excavating operation of such components. Memory 66 is used to both store various software for conducting the different excavating methods in accordance with the invention, and to receive operator input regarding elevation and other parameters concerning the face of the material being excavated. With excavation being coordinated by microprocessor control, a single operator can be employed with his attention being focused on the orientation of discharge conveyor boom 26.

In compliance with the statute, the invention has been described in language more or less specific as to structural and methodical features. It is to be understood, however, that the invention is not limited to the specific features shown and described, since the means and construction comprise preferred forms of putting the invention into effect. The invention is, therefore, claimed in any of its forms or modifications within the proper scope of the appended claims, appropriately interpreted in accordance with the docturine of equivalents.

We claim:

1. An excavating apparatus for breaking and removing material away from an upright face of material comprising:

a vehicle having first and second longitudinal ends;

means supporting the vehicle for movement in a generally longitudinal direction;

rotary cutter means for engaging and dislodging material from an upright face located outwardly from the first longitudinal end of the vehicle, the cutter means being mounted adjacent the vehicle first longitudinal end for rotation about a transverse axis, the cutter means being mounted for elevational movement relative to the vehicle;

power drive means for rotating the cutter means about its transverse axis;

power driven conveyor means on the vehicle for transporting material away from the first longitudinal end of the vehicle;

a collector pan extending transversely across the first longitudinal end of the vehicle, the collector pan having a front transverse edge and upwardly facing surfaces that incline to the conveyor means;

positioning means for moving the cutter means elevationally relative to the vehicle and collector pan; and combination grading and collecting means mounted to the vehicle at an elevational position below the front transverse edge of the collector pan for, (a) gathering material dislodged by the cutter means from an upright face and transporting such material to the conveyor means, and (b) forming a surface over which the vehicle is adapted to travel by removing material from such surface and transporting such material to the conveyor means.

2. The excavating apparatus of claim 1 wherein the rotary cutting means comprises a rotary cutter, and the apparatus further comprises:

enabling means for accommodating elevational movement of the entire rotary cutter above and below the collector pan in front of the front transverse edge of the collector pan without requiring changing of the elevational position of such front transverse edge.

3. The excavating apparatus of claim 2 wherein, the positioning means comprises:

a pair of boom arms pivotally extending from the first longitudinal end of the vehicle, the rotary cutter means being mounted at outer ends of the boom arms, the boom arms being adjustable in length, thereby enabling longitudinal as well as elevational movement of the rotary cutter means relative to the vehicle and collector pan; and the enabling means comprises:

a pair of longitudinal slots provided through the collector pan and extending to its front transverse edge, the boom arms being extendible through the slots.

4. The excavating apparatus of claim 3 wherein the collector pan and combination means are mounted to the vehicle by a common frame, the common frame being mounted for elevational movement relative to the vehicle to move the collector pan and combination means vertically in unison.

5. The excavating apparatus of claim 3 wherein, the collector pan and combination means are mounted to the vehicle by a common frame, the common frame being mounted for elevational movement relative to the vehicle to move the collector pan and combination means vertically in unison; and one end of the conveyor means being connected to the common frame and elevationally movable therewith.

6. The excavating apparatus of claim 1 wherein the collector pan and combination means are mounted to the vehicle by a common frame, the common frame being mounted for elevational movement relative to the vehicle to move the collector pan and combination means elevationally in unison.

7. The excavating apparatus of claim 6 wherein the positioning means comprises:

a pair of boom arms pivotally extending fronm the first longitudinal end of the vehicle, the rotary cutter means being mounted at outer ends of the boom arms, the boom arms being adjustable in length, thereby enabling longitudinal as well as elevational movement of the rotary cutter means relative to the vehicle and collector pan.

8. The excavating apparatus of claim 6 wherein one end of the conveyor means is connected to the common frame and elevationally moves therewith.

9. The excavating apparatus of claim 7 wherein one end of the conveyor means is connected to the common frame and elevationally moves therewith.

10. The excavating apparatus of claim 1 wherein the positioning means comprises:

a pair of boom arms pivotally extending from the first longitudinal end of the vehicle, the rotary cutter means being mounted at outer ends of the boom arms, the boom arms being adjustable in length, thereby enabling longitudinal as well as elevational movement of the rotary cutter means relative to the vehicle and collector pan.

11. An excavating apparatus for breaking and removing material away from an upright face of material comprising:

a vehicle having first and second longitudinal ends;

means supporting the vehicle for movement in a generally longitudinal direction;

rotary cutter means mounted at the first longitudinal end of the vehicle for engaging and dislodging material from an upright face located outwardly from the first longitudinal end of the vehicle, the cutter means being mounted relative to the vehicle for rotation about a transverse axis;

power drive means for rotating the cutter means about its transverse axis;

power driven conveyor means on the vehicle for transporting material away from the first longitudinal end of the vehicle;

a collector pan extending transversely across the first longitudinal end of the vehicle, the collector pan having a front transverse edge and upwardly facing surfaces that incline to the conveyor means;

combination grading and collecting means mounted to the vehicle at an elevational position below the front transverse edge of the collector pan for, (a) gathering material dislodged by the cutter means from an upright face and transporting such material to the conveyor means, and (b) grading a surface over which the vehicle is adapted to travel by removing material from such surface and transporting such material to the conveyor means; and positioning means operatively connected between the vehicle and cutter means for moving the cutter means relative to the collector pan in both longitudinal and elevational directions above and below the front transverse edge and between positions located longitudinally outward and longitudinally rearward of the front transverse edge.

12. The excavating apparatus of claim 11 wherein the rotary cutting means comprises a rotary cutter, and the apparatus further comprises:

enabling means for accommodating elevational movement of the rotary cutter means past the front transverse edge of the collector pan without requiring changing of the elevational position of such front transverse edge.

13. The excavating apparatus of claim 12 wherein, the positioning means comprises:

a pair of boom arms pivotally extending from the first longitudinal end of the vehicle, the rotary cutter means being mounted at outer ends of the boom arms, the boom arms being adjustable in length; the enabling means comprises:

a pair of longitudinal slots provided through the collector pan and extending to its front transverse edge, the boom arms being extendible through the slots; and the collector pan and combination means are mounted to the vehicle by a common frame, the common frame being mounted for elevational movement relative to the vehicle to move the collector pan and combination means vertically in unison.

14. The excavating apparatus of claim 11 wherein the positioning means comprises:

a pair of boom arms pivotally extending from the first longitudinal end of the vehicle, the rotary cutter means being mounted at outer ends of the boom arms, the boom arms being adjustable in length.

15. The excavating apparatus of claim 11 wherein the collector pan and combination means are mounted to the vehicle by a common frame, the common frame being mounted for elevational movement relative to the vehicle to move the collector pan and combination means elevationally in unison.

16. A method of excavating a face of material comprising at least the following steps:

(a) positioning an excavating vehicle, having a rotary cutter and a conveyor system, over a surface and adjacent a face of material to be excavated;

(b) providing a collector pan on said vehicle (c) positioning said rotary cutter beneath said collector pan and moving said rotary cutter as it is rotating into the face at a location adjacent where the surface and face intersect;

(d) gathering material removed from the face by said rotary cutter adjacent the surface and transporting such material to said conveyor system on said vehicle;

(e) moving said rotary cutter upwardly into the face, to a top portion of the face, at an elevational position above said vehicle collector pan, said collector pan collecting and directing material removed from the face by said rotary cutter at locations elevationally above the collector pan and transporting such material to the vehicle conveyor system;

(f) moving the vehicle in the direction of the face;

(g) moving said rotary cutter into the face adjacent the top portion of the face and downwardly past said collector pan; and (h) repeating steps b through g above.

17. The excavating method of claim 16 wherein the step of moving the vehicle in the direction of the face is comprised in two discrete steps, a first step occurring when the rotating cutter is elevationally lower than the collector pan, a second step occurring when the rotating cutter is elevationally higher than the collector pan.

18. The excavating method of claim 16 wherein movement of the rotating cutter into the face in steps (c) and (g) is of a distance approximately one cutter diameter in depth, and maintaining such depth engagement throughout elevational movement of the rotating cutter.

19. The excavating method of claim 17 wherein movement of the rotating cutter into the face in steps (c) and (g) is of a distance approximately one cutter diameter in depth, and maintaining such depth engagement throughout elevational movement of the rotating cutter.

20. The excavating method of claim 16 further comprising:

coordinating movement of (1) the rotating cutter into the face, (2) the elevational movement of the rotating cutter, and (3) the vehicle movement, to maintain a substantially vertical face throughout excavation.

21. The excavating method of claim 17 further comprising:

coordinating movement of (1) the rotating cutter into the face, (2) the elevational movement of the rotating cutter, and (3) the vehicle movement, to maintain a substantially vertical face throughout excavation.

22. The excavating method of claim 18 further comprising:

coordinating movement of (1) the rotating cutter into the face, (2) the elevational movement of the rotating cutter, and (3) the vehicle movement, to maintain a substantially vertical face throughout excavation.

23. The excavating method of claim 16 further comprising:

continually moving the vehicle in the direction of the face of material throughout steps (c) through (g).

24. The excavating method of claim 23 further comprising:

maintaining elevational velocity of the rotating cutter generally constant throughout elevational movements thereof;

decreasing vehicle velocity in the direction of the face of material when the rotating cutter is elevationally higher than the collector pan; and increasing vehicle velocity in the direction of the face of material when the rotating cutter is elevationally lower than the collector pan.

25. The excavating method of claim 16 further comprising;

conducting step (d) with a combination material gathering and grading device, and grading the surface with the combination device as the vehicle moves.

26. The excavating method of claim 25 wherein the step of moving the vehicle in the direction of the face is comprised in two discrete steps, a first step occurring when the rotating cutter is elevationally lower than the collector pan, a second step occurring when the rotating cutter is elevationally higher than the collector pan.

27. The excavating method of claim 25 further comprising:

continually moving the vehicle in the direction of the face of material throughout steps (c) through (g).

* * * * *